US006592953B1

(12) United States Patent
Ceruti et al.

(10) Patent No.: US 6,592,953 B1
(45) Date of Patent: Jul. 15, 2003

(54) RECEIVING SHEET FOR INK-JET PRINTING COMPRISING A COPOLYMER

(75) Inventors: Luca Ceruti, Bergeggi (IT); Roberto Sardelli, Savona (IT); Gabriele Impellizzieri, Vispa di Carcare (IT)

(73) Assignee: Ferrania, S.p.A., Ferrania (IT)

( * ) Notice: Subject to any disclaimer, the term of this patent is extended or adjusted under 35 U.S.C. 154(b) by 61 days.

(21) Appl. No.: 09/711,208

(22) Filed: Nov. 9, 2000

(30) Foreign Application Priority Data

Nov. 22, 1999 (IT) ..... SV99A0037

(51) Int. Cl.[7] ..... B41M 5/00

(52) U.S. Cl. ..... 428/32.24; 428/32.27; 428/32.28

(58) Field of Search ..... 347/105; 428/195, 428/32.24, 32.27, 32.28

(56) References Cited

U.S. PATENT DOCUMENTS

| | | | | |
|---|---|---|---|---|
| 4,425,405 A | | 1/1984 | Murakami et al. | 428/347 |
| 4,503,111 A | | 3/1985 | Jaeger et al. | 428/195 |
| 4,649,064 A | | 3/1987 | Jones | 427/256 |
| 4,686,118 A | | 8/1987 | Arai et al. | 427/261 |
| 4,904,519 A | | 2/1990 | Newman | 428/203 |
| 5,725,961 A | * | 3/1998 | Ozawa et al. | 428/500 |
| 5,919,558 A | | 7/1999 | Chao | 428/327 |
| 5,939,469 A | | 8/1999 | Fussnegger et al. | 523/161 |

FOREIGN PATENT DOCUMENTS

| | | |
|---|---|---|
| EP | 0763433 | 5/1996 |

* cited by examiner

*Primary Examiner*—B. Hamilton Hess
(74) *Attorney, Agent, or Firm*—Mark A. Litman & Assoc. P.A.

(57) ABSTRACT

The present invention refers to an ink jet receiving sheet comprising a support and at least an ink receiving layer comprising a binder selected from the group consisting of gelatin and gelatin derivatives, characterized in that said at least an ink receiving layer comprises at least a copolymer consisting in at least one N-vinylpyrrolidone monomer and at least a second monomer selected from the group of N-vinylcaprolactam monomers and N-vinylpiperidone monomers to improve post printed drop sweating in the resulting image, still maintaining a good glossiness.

5 Claims, No Drawings

RECEIVING SHEET FOR INK-JET PRINTING COMPRISING A COPOLYMER

FIELD OF THE INVENTION

The invention relates to an ink receiving sheet for ink-jet printing and, more particularly, to a receiving sheet comprising a copolymer consisting in at least one N-vinylpyrrolidone monomer and at least one second monomer selected from the group of N-vinylcaprolactam, and N-vinylpiperidone monomers to improve post printed drop sweating in the resulting image, still maintaining a good glossiness.

BACKGROUND OF THE INVENTION

Ink jet printing has become increasingly popular, particularly for so-called "desk-top publishing", because of its capability to produce small volumes of printed matter from digital input at high throughput speeds. Recent equipment developments have led to the introduction of multi-color ink jet printers that integrate colored graphics and text. To some extent, however, the applications of ink jet printing have been limited due to the demanding requirements the ink receptors must meet in order to provide high quality text and graphics.

It is desirable that receiving media for inkjet printing are capable of absorbing significant amount of liquid to ensure that the surface of said receptors be dry and non tacky to the touch after printing; but it is also desirable to maintain durability of printing image.

In case of multicolor ink-jet receptors, the ink-receiving layer is often subjected to multiple print, one for each primary color (yellow, magenta and cyan). During the first or second print, the amount of organic compounds absorbed in the layer can be partially desorbed creating on the image surface a local organic compound concentration that are visible as drop. Where a yellow ink is absorbed by the ink receiving layer after that cyan and magenta inks have been already absorbed therein, it is possible to have the formation of yellow colored drops in specific areas on the surface of the receiving layer, areas that have been saturated with cyan and magenta inks and that are no more able to properly absorb additional inks. This problem is generally known as post printed drop sweating.

U.S. Pat. No. 4,649,064 discloses a rapid-drying image-recording element adapted for water-based liquid ink marking, in devices such as pen plotters, ink jet printers and the like, comprising a support having thereon a hydrophilic ink-receiving layer which is cross-linked to a degree sufficient to render it non-blocking and waterfast while permitting it to rapidly absorb a water-based liquid ink. The element is utilised in combination with a water-based liquid ink that comprises a water-dispersible cross-linkable colorant/resin composition and the ink-receiving layer contains a cross-linking agent which cross-links the colorant/resin composition to thereby render the ink markings smear-resistant, abrasion-resistant and waterfast.

U.S. Pat. No. 5,919,558 discloses typical water soluble and non-water soluble polymeric binders for inkjet coatings, such as, for example, poly(vinylpyrrolidone), vinylpyrrolidone-vinyl acetate copolymers, or mixtures thereof. U.S. Pat. No. 4,425,405 discloses such a mixture applied on at least one surface of a paper substrate or incorporated internally of the substrate with a white filler in a pigment-to-binder weight ratio of 10:1 to 0.2:1. In addition, U.S. Pat. No. 4,503,111 discloses the use of poly(vinylpyrrolidone) as the binder in an inkjet recording sheet which uses a hydrophobic substrate prepared from a flexible, transparent plastic material.

U.S. Pat. No. 5,939,469 discloses a base material and a coating on said base material for binding anionic dyes of ink-jet inks to the base; said coating comprises (a) 50 to 99.5% by weight of a basic vinyl heterocycle selected from the group consisting of N-vinylimidazole, 2-methyl-1-vinylimidazole and a mixture thereof; said vinyl heterocycle having a pKa of at least 3.8; (b) 0 to 49.5% by weight of a further copolymerizable monomer; and (c) 0.5 to 10% by weight of a crosslinker. In particular, the further copolymerizable comonomer (b) is selected from the group consisting of N-vinylpyrrolidone, N-vinylcaprolactam, N-vinyl-1,4-dihydropyridine and a mixture thereof.

U.S. Pat. No. 4,904,519 describes an ink jet recording sheet comprising a transparent polymeric backing having on at least one major surface thereof a transparent, ink-receptive layer comprising a cross-linked, hydrolyzed copolymer of a vinyl ester comonomer selected from the group consisting of vinyl acetate, vinyl propionate and vinyl stearate, and a vinyl amide comonomer selected from the group consisting of N-vinyl pyrrolidone and vinyl acetamide, the degree of hydrolysis being from about 80 to 95%, and the cross-linking being effected by an agent selected from the group consisting of borates, titanates, dichromates and aldehydes.

When the ink receptor media is printed with high quantity of ink, water and other components are absorbed by the coated layer and retained inside the film. At high humidity conditions, they tend to come off the layer and to coalesce in form of small drops on the surface, causing an oily feeling to touch and several handling problems. EP Patent Application 763,433 claims an ink jet recording medium containing at least one nitrogen-containing component to be selected from poly(vinylpyrrolidone), polyimines, gelatines or quaternary polymers. It should be assumed that one or more of these nitrogen-containing entities can function at least partially as a mordant.

A wide variety of the vinyl pyrrolidone polymers and copolymers of vinyl pyrrolidone with copolymerizable monomers such as vinyl acetate, methyl acrylate, methyl methacrylate, ethyl acrylate, ethyl methacrylate, butyl acrylate, butyl methacrylate, methyl acrylamide, methyl methacrylamide and vinyl chloride are commercially available and/or are disclosed in U.S. Pat. Nos. 4,741,969; 4,503,111; 4,555,437 and 4,578,285 and PCT application 92-09,440. The concentration of the vinyl pyrrolidone polymer in the ink-receptive layer is subject to some variation. It is used in sufficient concentration to absorb or mordant the printing ink in the layer. A useful concentration is generally in the range of about 15 to about 50 percent by weight based on the total dry weight of the layer, although concentrations somewhat in excess of about 50 weight percent and concentrations somewhat below about 15 weight percent may be used in the practice of the invention.

JP Patent Application 63-307,979 discloses a coating for ink-jet printing containing a hydrophilic soluble copolymer of vinylimidazole, vinylpyrrolidone and vinylbenzylsulfonic acid (60:30:10).

Despite polyvinylpyrrolidone derivatives work as good mordants with the majority of dyes used in ink formulations, they have low ability to fix other components (such as alkylene glycoles, low molecular weight polyoxyethylene compounds) that cause the bleeding phenomen. Hence, there is still a need for improved ink receptors that have minimum post printed drop sweating, still maintaining a good glossiness.

SUMMARY OF THE INVENTION

The present invention refers to an ink jet receiving sheet which comprises a support and at least one ink receiving layer comprising a binder selected from the group consisting of gelatin and gelatin derivatives, characterized in that said at least one ink receiving layer comprises at least a copolymer consisting of at least one N-vinylpyrrolidone monomer and at least one second monomer selected from the group of N-vinylcaprolactam monomer and N-vinylpiperidone monomer, to improve post printed drop sweating in the resulting image, still maintaining a good glossiness.

DETAILED DESCRIPTION OF THE INVENTION

The ink jet receiving sheet of the invention comprises a support and at least one ink receiving layer comprising a binder selected from the group consisting of gelatin and gelatin derivatives. Any gelatin made from animal collagen can be used, but gelatin made from pig skin, cow skin or cow bone collagen is preferable. The kind of gelatin is not specifically limited, but lime-processed gelatin, acid processed gelatin, amino group inactivating gelatin (such as acetylated gelatin, phthaloylated gelatin, malenoylated gelatin, benzoylated gelatin, succinoylated gelatin, methyl urea gelatin, phenylcarbamoylated gelatin, and carboxy modified gelatin), or gelatin derivatives (for example, gelatin derivatives disclosed in JP Patents 38-4854/1962, 39-5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and GB Patents 861,414 and 103,189) can be used singly or in combination.

The gelatin binder ordinarily makes up from 30 to 90 weight % and preferably 50 to 80 weight % based on the solid content of the at least one ink receiving layer compositions. Preferably, the ink receiving layers totally comprise a binder amount of from 1 to 20 g/m$^2$, and more preferably from 2 to 10 g/m$^2$.

The at least one receiving layer comprises at least a copolymer consisting in at least one N-vinylpyrrolidone monomer and at least one second monomer selected from the group of N-vinylcaprolactam monomer and N-vinylpiperidone monomer. Useful N-vinylcaprolactam monomers (the term generically including N-vinylcaprolactam and its derivatives that are polymerizable, with non-limiting examples provided herein) and N-vinylpiperidone monomers (the term generically including N-vinylpiperidone and its derivatives that are polymerizable, with non-limiting examples provided herein) also include monomers having substituent groups on an N-vinylcaprolactam or an N-vinylpiperidone nucleous. Useful N-vinylcaprolactam and N-vinylpiperidone monomers contained in the ink receiving layer(s) are those protected in the 3-position, as disclosed in U.S. Pat. No. 5,955,606. The monomers can be prepared by reacting vinylcaprolactam or vinylpiperidone with a strong base at low temperatures to give an enolate and introducing a protecting group into the 3-position of vinylcaprolactam or vinylpiperidone. Examples of suitable N-vinylcaprolactam or N-vinylpiperidone monomers, but not limited to, are N-vinyl-5-piperidone, N-vinyl-4-methylpiperidone, N-vinyl-4-propylpiperidone, N-vinyl-4-butylpiperidone, N-vinyl-6-butylpiperidone, N-vinylcaprolactam, N-vinyl-4-methylcaprolactam, N-vinyl-6-methylcaprolactam, N-vinyl-6-propylcaprolactam and N-vinyl-7-butylcaprolactam. The strong base may be exemplified by t-butyllithium, sodium hydrate and n-butyllithium. This monomer preparation is carried out in an solvent, examples include n-pentane, n-hexane, n-heptane, cyclohexane, ethylether and tetrahydrofuran. As a protecting group source, t-butylchloroformate, isobutylchloroformate, di(t-butyl) dicarbonate, methanesulfonylchloride, methanesulfonic anhydride, tetrahydropyran, 2-chlorotetrahydrofuran, trimethylsilylchloride, 4-methoxybenzylchloride, 4-nitrobenzylchloride, diethylisopropylsilylchloride and t-dimethylsilylchloride can be used.

Useful N-vinylpyrrolidone monomers also include monomers having substituent groups on an N-vinylpyrrolidone nucleus. N-vinylpyrrolidone monomers contained in the copolymer used in the present invention are available as commercial chemicals from a number of suppliers. Examples of suitable N-vinylpirrolidone monomers, but not limited thereto, are N-vinylpyrrolidone, N-vinyl-4-butylpyrrolidone, N-vinyl-4-propylpyrrolidone, N-vinyl-4-ethylpyrrolidone, N-vinyl-4-methylpyrrolidone, N-vinyl-4-methyl-5-ethylpyrrolidone, N-vinyl-4-methyl-5-propylpyrrolidone, N-vinyl-4,5-dimethylpyrrolidone, N-vinyl-5-methyl-5-ethylpyrrolidone, N-vinyl-5,5-dimethylpyrrolidone, N-vinyl-5-propylpyrrolidone, N-vinyl-5-butylpyrrolidone, N-vinyl-5-methylpyrrolidone, N-vinyl-3-methylpyrrolidone, N-vinyl-3-ethylpyrrolidone, N-vinyl-3,4,5-trimethylpyrrolidone and N-vinyl-3,4,5-trimethyl-3-ethylpyrrolidone. Of these several compounds, N-vinylpyrrolidone is most preferred.

The monomers can be easily polymerized in ordinary radical polymerization techniques using radical polymerization initiators. By using the above-mentioned monomers, copolymers which have an appropriate molar ratio in monomers can be prepared. These are polymerized in bulk polymerization or in a solution polymerization. For the solvent for polymerization, cyclohexanone, methylethylketone, benzene, toluene, dioxane, dimethylformamide alone or combinations thereof may be used. Usually, the polymerization is carried out in the presence of a polymerization initiator, such as benzoylperoxide, 2,2'-azobisisobutyronitrile (AIBN), acetyl peroxide, lauryl peroxide, or t-butylperacetate.

Preferably, the N-vinylcaprolactam and N-vinylpiperidone monomers contained in the copolymer used in the present invention are incorporated by polymerization in proportions of from 10 to 90%, more preferably from 20 to 80%, most preferably from 30 to 70%, based on the molecular weight of the total copolymer.

The ink-jet receiving sheet of the present invention totally comprises an amount of the above-described copolymer in the range from about 0.1 to about 10 g/m$^2$, preferably from about 0.2 to about 5.0 g/m$^2$.

The ink receiving layer(s) may also contain a glossiness improving agent represented by monosaccharides and/or oligosaccharides and/or polysaccharides having a recurring unit comprising five or six carbon atoms. Said saccharides can be hydrogenated or non-hydrogenated. Preferred recurring units include, for example, glucose, xylose, mannose, arabinose, galactose, sorbose, fructose, fucose, adonitol, arbitol, inositol, xylitol, dulcitol, iditol, lactitol, mannitol, sorbitol, and the like. The average molecular weight of said saccharides ranges from 1,000 to 500,000, preferably from 1,000 to 30,000.

Hydrogenated and non-hydrogenated saccharides useful in the present invention are commercially available, for example, under the trade designation Polysorb™ or Glucidex™, from Roquette, Lille, France. The preparation of hydrogenated and non-hydrogenated saccharides usually starts from natural products (like starch, agar, tragacanth gum, xanthan gum, guar gum, and the like) by means of enzymatic processes (to reduce the average molecular weight) and of reducing processes (to saturate the molecule, in case of hydrogenated saccharides).

The above-described glossiness improving agents ordinarily make up to 30 weight % and preferably up to 20 weight % based on the solid content of the ink receiving layer compositions. Preferably, the resulting ink receiving layers totally comprise a glossiness improving agent amount from 0.1 to 5 g/m$^2$, preferably from 0.5 to 3 g/m$^2$.

The ink receiving layer(s) may also contain an agent to reduce the print-image drying time. Image drying time, the period the ink is moist after it is ejected onto the print medium, is an important characteristic because, generally, a shorter drying time results in sharper images and allows faster print speeds. The longer an ink dot takes to dry, the greater the chances that the dot will smear, will bleed into an adjacent color ink or will wick into the fibers of the print media. The drying time reducing agent used in the present invention preferably is a water-soluble cationic polymer as those described in EP Patent Application 830,952. Most preferably, the drying time reducing agent is selected from the group consisting of cation modified polyvinyl alcohol and cation modified polyvinyl pyrrolidone compounds. The cation modified polyvinyl alcohols refer to a copolymer of a vinyl alcohol and a monomer containing a cationic group, and examples thereof are described in JP-A 62-138280. The cation modified polyvinyl pyrrolidone compounds refer to a copolymer of vinyl pyrrolidone and a monomer containing a cationic group. Examples of the monomer containing a cationic group include a vinylimidazole in a quaternary salt form, dialkylaminoethylmethacrylate in a quaternary salt form and methacrylamidotrialkylammonium.

The drying time reducing agent is added in an amount of from 5 to 80%, preferably from 10 to 50% by weight respect to the total vinylic polymers of the layer.

The support used in the ink jet receiving sheet of the invention includes any conventional support for ink jet receiving sheet. A transparent or opaque support can be used according to the final use of the ink jet receiving sheet. Useful examples of transparent support include films of polyester resins, cellulose acetate resins, acryl resins, polycarbonate resins, polyvinyl chloride resins, poly(vinylacetal) resins, polyether resins, polysulfonamide resins, polyamide resins, polyimide resins, cellophane or celluloid and a glass plate. The thickness of the transparent support is preferably from 10 to 200 $\mu$m. Useful examples of opaque support include paper, coat paper, synthetic paper, resin-covered paper, and pigment-containing opaque films, but synthetic paper, a resin-covered paper or various films are preferable in view of glossiness or smoothness, and resin-covered paper or polyester film are preferable in view of touchiness or luxuriousness.

The base paper constituting the resin-covered paper useful in the invention is not specifically limited, and any conventional paper can be used, but a smooth paper used as a conventional photographic support is preferable. The pulp used for the preparation of the base paper, singly or in admixture, is constituted by natural pulp, reproduction pulp, chemical pulp such as hardwood bleached kraft pulp, softwood bleached kraft pulp, high yield pulps such as undwood pulp or thermomechanical pulp, recycled pulps and non-wood pulps such as cotton pulp or synthetic pulp. These base papers may contain additives usually employed in paper manufacture such as sizing agents, binders, fixing agents, yield-improving agents, cationated agents, paper stiffness enhancing agents, reinforcing agents, fillers, anti-static agents, fluorescent brightening agents or dyes. A surface sizing agent, a surface reinforcing agent, a fluorescent agent, an antistatic agent and an anchoring agent may be coated on the surface of the material.

The thickness of the base paper is not specifically limited, but is preferably from 10 to 200 $\mu$m. A base paper having a smooth surface is preferable, which is obtained by applying a pressure to or calendering the paper during or after papering. The weight of the base paper is preferably from 30 to 250 g/m$^2$. The resin used in the manufacturing of resin-covered paper is preferably a polyolefin resin or a resin capable of being hardened with an electron beam. The polyolefin resin includes an olefin homopolymer such as a low density polyethylene, a high density polyethylene, polypropylene or polypentene, an olefin copolymer such as ethylene-propylene copolymer or their mixture, each having various densities or melt viscosity indexes (melt index). These resins can be used singly or in combination.

The resin for the resin-covered paper preferably contains various additives, for example, white pigments such as titanium oxide, zinc oxide, talc or calcium carbonate, a fatty acid amide such as stearic acid amide or arachidic acid amide, a fatty acid metal salt such as zinc stearate, calcium stearate, aluminum stearate or magnesium stearate, an antioxidant such as Irganox™ 1010 or Irganox™ 1076, blue pigments or dyes such as cobalt blue, ultramarine, or phthalocyanine blue, magenta pigments or dyes such as cobalt violet, fast violet or manganese violet, a brightening agent and a UV absorber. These additives can be suitably used in combination.

The resin-covered paper, which is the support preferably used in the present invention, is manufactured by a so-called extrusion method, casting a thermally fused resin (for example, fused polyolefin) on the moving paper, whereby both surfaces of the paper are covered with the resin. When the paper is covered with a resin capable of being hardened with electron beam irradiation, the resin is coated with a conventional coater such as a gravure coater or a blade coater and then is irradiated with electron beam to harden the coated resin. Before the paper is coated with a resin, the surface of the paper is preferably subjected to activation treatment such as corona discharge treatment or flame treatment. The surface of the support on the ink receiving layer side is glossy or matted depending upon its usage, but glossy surface is preferable. The back side of the support is not necessarily covered with a resin, but is preferably covered with a resin to prevent curling. The back surface of a support is ordinarily non-glossy, but the back surface or both surfaces of the support are optionally subjected to activation treatment such as corona discharge treatment or flame treatment. The thickness of a covered resin is not specifically limited, but is ordinarily from 5 to 50 $\mu$m.

A subbing layer (also called primer layer) may be provided to improve the adhesion between the film support and the ink receiving layer(s). Useful subbing layers for this purpose are widely known in the photographic art and include, for example, polymers of vinylidene chloride such as vinylidene chloride/acrylonitrile/acrylic acid or vinylidene chloride/methyl acrylate/itaconic acid terpolymers, gelatin, gelatin derivatives, caseine, caseine derivatives.

In addition to the above mentioned ingredients, the ink receiving layer(s) can comprise several adjuvants dispersed therein. Useful adjuvants are represented by fillers, surfactants, mordants, matting agents, hardeners, plasticizers, and the like.

Inorganic and organic particles can be used as fillers. Useful examples of fillers are represented by silica (colloidal silica), alumina or alumina hydrate (aluminazol, colloidal alumina, cation aluminum oxide or its hydrate and pseudo-boehmite), a surface-processed cation colloidal silica, aluminum silicate, magnesium silicate, magnesium carbonate, titanium dioxide, zinc oxide, calcium carbonate, kaoline, talc, clay, zinc carbonate, satin white, diatomaceous earth, synthetic amorphous silica, aluminum hydroxide, lithopone, zeolite, magnesium hydroxide and synthetic mica. Of these inorganic pigments, porous inorganic pigments are preferable such as porous synthetic silica, porous calcium carbonate and porous alumina.

Useful examples of organic fillers are represented by polystyrene, polymethacrylate, polymethylmethacrylate, elastomers, ethylene-vinyl acetate copolymers, polyesters, polyester copolymers, polyacrylates, polyvinylethers, polyamides, polyolefines, polysilicones, guanamine resins, polytetrafluoroethylene, elastomeric styrenebutadiene rubber (SBR), urea resins, urea-formalin resins. Such organic fillers may by used in combination, and/or in place of the above-mentioned inorganic fillers.

The above mentioned fillers are added to the ink receiving layer(s) in an amount of from 0.1 to 5 g/m$^2$, preferably from 0.2 to 3 g/m$^2$, most preferably from 0.3 to 1 g/m$^2$.

Preferred examples of surfactants include anionic surfactants, amphoteric surfactants, cationic surfactants, and nonionic surfactants.

Examples of anionic surfactants include alkylsulfocarboxylates, α-olefin sulfonates, polyoxyethylene alkyl ether acetates, N-acyl amino acids and the salts thereof, N-acyl methyltaurine salts, alkylsulfates, polyoxyalkylether sulfates, polyoxyalkylether phosphates, rosin soap, castor oil sulfate, lauryl alcohol sulfate, alkylphenol phosphates, alkylphosphates, alkylallylsulfonates, diethylsulfosuccinate, diethylhexylsulfosuccinate, and dioctylsulfosuccinate.

Examples of cationic surfactants include 2-vinylpyridine derivatives and poly-4-vinylpyridine derivatives.

Examples of amphoteric surfactants include lauryl dimethyl aminoacetic acid betaine, 2-alkyl-N-carboxymethyl-N-hydroxyethyl imidazolinium betaine, propyldimethylaminoacetic acid betaine, polyoctylpolyaminoethyl glycine, and imidazoline derivatives.

Useful examples of non-ionic surfactants include non-ionic fluorinated surfactants and non-ionic hydrocarbon surfactants. Useful examples of non-ionic hydrocarbon surfactants include ethers, such as polyoxyethylene nonyl phenyl ethers, polyoxyethylene octyl phenyl ethers, polyoxyethylene dodecyl phenyl ethers, polyoxyethylene alkyl allyl ethers, polyoxyethylene oleyl ethers, polyoxyethylene lauryl ethers, polyoxyethylene alkyl ethers, polyoxyalkylene alkyl ethers; esters, such as polyoxyethylene oleate, polyoxyethylene distearate, sorbitan laurate, sorbitan monostearate, sorbitan monooleate, sorbitan sesquioleate, polyoxyethylene monooleate, and polyoxyethylene stearate; and glycol surfactants. Specific examples of non-ionic surfactants include octylphenoxy polyethoxy ethanols, such as Triton™ X-100, X-114, and X-405, available from Union Carbide Co., Danbury, Conn.; acetylenic diols such as 2,4,7,9-tetramethyl-5-decyl-4,7-diol and the like, such as Surfynol™ GA and Surfynol™ CT-136, available from Air Products & Chemicals Co., Allentown, Pa., trimethyl nonylpolyethylene-glycol ethers, such as Tergitol™ TMN-10 (containing 10 oxyethylene units, believed to be of formula $C_{12}H_{25}O(C_2H_4O)_5H$), available from Union Carbide Co., Danbury, Conn.; non-ionic esters of ethylene oxide, such as Merpol™ SH (believed to be of formula $CH_3(CH_2)_{12}(OC_2H_4)_8OH$), available from E. I. Du Pont de Nemours & Co., Wilmington, Del.; non-ionic esters of ethylene oxide and propylene oxide, such as Merpol™ LFH (believed to be of formula $CH_3(CH_2)n(OC_2H_4)_8(OC_3H_6)_8$ OH, where n is an integer from about 12 to about 16) available from E. I. Du Pont de Nemours & Co., Wilmington, Del., and the like, as well as mixtures thereof. Non-limiting examples of non-ionic fluorinated surfactants include linear perfluorinated polyethoxylated alcohols (e.g., Zonyl™ FSN, Zonyl™ FSN-100, Zonyl™ FSO, and Zonyl™ FSO-100 available from DuPont Specialty Chemicals, Wilmington, Del.), fluorinated alkyl polyoxyethylene ethanols (e.g., Fluorad™ FC-170C available from 3M, St. Paul, Minn.), fluorinated alkyl alkoxylates (e.g., Fluorad™ FC-171 available from 3M, St. Paul, Minn.), fluorinated alkyl esters (e.g., Fluorad™ FC-430, FC-431, and FC-740 available from 3M, St. Paul, Minn.) and fluorine-substituted alkyl esters and perfluoroalkyl carboxylates (for example, the F-tergent series manufactured by Neos Co., Ltd., the Lodyne series manufactured by Ciba-Geigy, the Monflor series manufactured by ICI, the Surfluon series manufactured by Asahi Glass Co., Ltd., and the Unidyne series manufactured by Daikin Industries, Ltd.). Preferred nonionic fluorocarbon surfactants include Zonyl™ FSO, Fluorad™ FC-170C, and Fluorad™ FC-171.

The above mentioned surfactants are added to the ink receiving layers in an amount of from 0.01 to 1.0 g/m$^2$, preferably from 0.05 to 0.50 g/m$^2$.

Additional mordants may be incorporated in the ink-receptive layer of the present invention. Such mordants are represented by cationic compounds, monomeric or polymeric, capable of complexing with the dyes used in the ink compositions. Useful examples of such mordants include quaternary ammonium block copolymers, such as Mirapol A-15 and MirapoL WT available from Miranol Inc., Dayton, N.J., prepared as disclosed in U.S. Pat. No. 4,157,388, Mirapol AZ-1 available from Miranol Inc., prepared as disclosed in U.S. Pat. No. 4,719,282, Mirapol AD-1 available from Miranol Inc., prepared as disclosed in U.S. Pat. No. 4,157,388, Mirapol 9, Mirapol 95, and Mirapol 175 available from Miranol Inc., prepared as disclosed in U.S. Pat. No. 4,719,282, and the like. Other suitable mordants comprise diamino alkanes, ammonium quaternary salts (such as polyvinylbenzyl quaternary ammonium salts disclosed in U.S. Pat. No. 4,794,067) and quaternary acrylic copolymer latexes.

Other suitable mordants are fluoro compounds, such as tetra ammonium fluoride hydrate, 2,2,2-trifluoroethylamine hydrochloride (Aldrich #18,038-6); 2,2,2-trifluoroethyltoluene sulfonate (Aldrich #17, 782-2); 1-(α,α,α-trifluoro-m-tolyl) piperazine hydrochloride, 4-bromo-α,α,α-trifluoro-o-toluidine hydrochloride, difluorophenylhydrazine hydrochloride, 4-fluorobenzylamine hydrochloride, 4-fluoro-α,α-dimethylphenethylamine hydrochloride, 2-fluoroethylaminehydrochloride, 2-fluoro-1-methyl pyridinium-toluene sulfonate, 4-fluorophenethylamine hydrochloride, fluorophenylhydrazine hydrochloride, 1-(2-fluorophenyl) piperazine monohydrochloride, 1-fluoro pyridinium trifluoromethane sulfonate.

Further mordants are monoammonium compounds as disclosed in, for example, U.S. Pat. No. 5,320,902, including (A) tetradecyl ammonium bromide (Fluka 87582), tetradodecyl ammonium bromide (Fluka 87249), tetrahexadecyl ammonium bromide (Fluka 87298), tetraoctadecyl ammonium bromide (Aldrich 35,873-8), and the like; (B) 2-coco trimethyl ammonium chloride (Arquad C-33, C-33W, C-50 from Akzo Chemie), palmityl trimethyl ammonium chloride (Adogen 444 from Sherex Chemicals), myristyl trimethyl ammonium bromide (Cetrimide BP Triple Crown America), benzyl tetradecyl dimethyl ammonium chloride (Arquad DM 14B-90 from Akzo Chemie), didecyl dimethyl ammonium bromide (Aldrich 29,801-8), dicetyl dimethyl ammonium chloride (Adogen 432CG, Sherex Chemicals), distearyl dimethyl ammonium methyl sulfate (Varisoft 137, 190-100P from Sherex Chemicals, Arosurf TA-100 from Sherex Chemicals), fat acid isopropyl ester dimethyl ammonium methyl sulfate (Rewoquat CR 3099 from Rewo Quimica, Loraquat CR 3099 from Dutton and Reinisch), tallow dimethyl trimethyl propylene diammonium chloride (Tomah Q-D-T from Tomah), and N-cetyl, N-ethyl morpholinium ethosulfate (G-263 from ICI Americas).

Additional mordants are phosphonium compounds, such as, for example, those disclosed in U.S. Pat. No. 5,766,809, including bromomethyl triphenyl phosphonium bromide (Aldrich 26,915-8), 3-hydroxy-2-methyl propyl triphenyl phosphonium bromide (Aldrich 32,507-4), 2-tetraphenyl phosphonium bromide (Aldrich 21,878-2), tetraphenyl phosphonium chloride (Aldrich 21879-0), hexadecyl tributyl phosphonium bromide (Aldrich 27,620-0), and stearyl tributyl phosphonium bromide (Aldrich 29,303-2).

Additional examples of mordants include those disclosed in U.S. Pat. Nos. 5,760,809; 5,457,486; 5,314,747; 5,320,902 and 5,441,795.

The ink receiving layer can be hardened with a hardener in order to improve water resistance or dot reproduction. Examples of hardeners include aldehyde compounds such as formaldehyde and glutaraldehyde, ketone compounds such as diacetyl and chloropentanedion, bis(2-chloroethylurea), 2-hydroxy-4,6-dichloro-1,3,5-triazine, reactive halogen-containing compounds disclosed U.S. Pat. No. 3,288,775, carbamoyl pyridinium compounds in which the pyridine ring carries a sulfo or sulfoalkyl group disclosed in U.S. Pat. Nos. 4,063,952 and 5,529,892, divinylsulfones, reactive olefin-containing compounds disclosed U.S. Pat. No. 3,635,718, N-methylol compounds disclosed U.S. Pat. No. 2,732,316, isocyanates disclosed U.S. Pat. No. 3,103,437, aziridine derivatives disclosed U.S. Pat. Nos. 3,017,280 and 2,983,611, carbodiimides disclosed U.S. Pat. No. 3,100,704, epoxy compounds disclosed U.S. Pat. No. 3,091,537, halogencarboxyaldehydes such as mucochloric acid, dioxane derivatives such as dihydroxy dioxane, and inorganic hardeners such as chromium alum, potash alum and zirconium sulfate. These hardeners can be used singly or in combination. The addition amount of hardener is preferably 0.01 to 10 g, and more preferably 0.1 to 5 g based on 100 g of the binder contained in the ink receiving layer.

The ink receiving layer may contain a matting agent in an amount of 0.005 to 0.1 g/m$^2$ in order to prevent adhesion defects such as blocking. Matting agents can be defined as particles of inorganic or organic materials capable of being discontinuously dispersed in a hydrophilic organic colloid. The inorganic matting agents include oxides such as silicon oxide, titanium oxide, magnesium oxide and aluminum oxide, alkali earth metal salts such as barium sulfate, calcium carbonate, and magnesium sulfate, light-insensitive silver halide particles such as silver chloride and silver bromide (each of which may contain a small amount of iodine), and glass particles. Besides these substances there may be used inorganic matting agents which are disclosed in DE Patent 2,529,321, in GB Patents 760,775 and 1,260,772, U.S. Pat. Nos. 1,201,905, 2,192,241, 3,053,662, 3,062,649, 3,257,296, 3,322,555, 3,353,958, 3,370,951, 3,411,907, 3,437,484; 3,523,022, 3,615,554, 3,635,714, 3,769,020, 4,021,245 and 4,029,504. The organic matting agents include starch, cellulose esters such as cellulose acetate propionate, cellulose ethers such as ethyl cellulose, and synthetic resins. The synthetic resins are water insoluble or sparingly soluble polymers which include a polymer of an alkyl(meth)acrylate, an alkoxyalkyl-(meth)acrylate, a glycidyl(meth)acrylate, a (meth)acrylamide, a vinyl ester such as vinyl acetate and acrylonitrile, an olefin such as ethylene or styrene and a copolymer of the above described monomers with other monomers such as acrylic acid, methacrylic acid, $\alpha,\beta$-unsaturated dicarboxylic acid, hydroxyalkyl(meth)acrylate, sulfoalkyl(meth)acrylate and styrene sulfonic acid. Further, a benzoguanamin-formaldehyde resin, an epoxy resin, nylon, polycarbonates, phenol resins, polyvinyl carbazol or polyvinylidene chloride can be used. Besides the above there are used organic matting agents which are disclosed in GB Patent 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344,554, 3,591,379, 3,754,924 and 3,767,448 and in JP Patents 49-106821/1974 and 57-14835/1982. These matting agents may be used alone or in combination.

The ink-receiving layer of the present invention can also comprise a plasticizer such as ethylene glycol, diethylene glycol, propylene glycol, polyethylene glycol, glycerol monomethylether, glycerol monochlorohydrin, ethylene carbonate, propylene carbonate, tetrachlorophthalic anhydride, tetrabromophthalic anhydride, urea phosphate, triphenylphosphate, glycerol monostearate, propylene glycol monostearate, tetramethylene sulfone, N-methyl-2-pyrrolidone, N-vinyl-2-pyrrolidone, and polymer latices with a low Tg-value such as polyethylacrylate, polymethylacrylate, etc.

The ink receiving layer can comprise biocides. Examples of suitable biocides include (A) nonionic biocides, such as 2-bromo-4'-hydroxyacetophenone (Busan 90 available from Buckman Laboratories); 3,5-dimethyl tetrahydro-2H-1,3,5-thiadiazine-2-thione (Slime-Trol RX-28 available from Betz Paper Chem Inc.); a nonionic blend of 5-chloro-2-methyl-4-isothiazoline-3-one, 75% by weight, and 2-methyl-4-isothiazolin-3-one, 25% by weight (available as Amerstat 250 from Drew Industrial Division; Nalcon 7647 from Nalco Chemical Company; and Kathon LX from Rohm and Haas Company); and the like, as well as mixtures thereof; (B) anionic biocides, such as potassium N-hydroxymethyl-N-methyl-dithiocarbamate (available as Busan 40 from Buckman Laboratories Inc.); an anionic blend of methylene bis-thiocyanate, 33% by weight, sodium dimethyldithiocarbamate, 33% by weight, and sodium ethylene bisdithiocarbamate, 33% by weight, (available as Amerstat 282 from Drew Industrial Division; AMA-131 from Vinings Chemical Company); sodium dichlorophene (G-4-40 available from Givaudan Corporation); and the like, as well as mixtures thereof; (C) cationic biocides, such as cationic poly(oxyethylene (dimethylamino)ethylene (dimethylamino) ethylene dichloride) (Busan 77 available from Buckman Laboratories Inc.); a cationic blend of bis (trichloromethyl) sulfone and a quaternary ammonium chloride (available as Slime-Trol RX-36 DPB865 from Betz Paper Chem. Inc.); and the like, as well as mixtures thereof. The biocide can be present in any effective amount;

typically, the biocide is present in an amount of from 0.1 to 3 percent by weight of the coating, although the amount can be outside this range.

The ink receiving layer of the invention may further contain various conventional additives such as colorants, colored pigments, pigment dispersants, lubricants, permeating agents, fixing agents for ink dyes, UV absorbers, antioxidants, dispersing agents, anti-foaming agents, leveling agents, fluidity improving agents, antiseptic agents, brightening agents, viscosity stabilizing and/or enhancing agents, pH adjusting agents, anti-mildew agents, anti-fungal agents, agents for moisture-proofing, agents for increasing the paper stiffness and anti-static agents.

The above-mentioned various additives can be added ordinarily in a range of 0 to 10 weight % based on the solid content of the ink receiving layer composition.

As a coating method of an ink receiving layer coating solution, any conventional coating method (for example, a curtain method, an extrusion method, an air-knife method, a slide coating, a roll coating method, reverse roll coating, solvent extrusion, dip coating processes and a rod bar coating method) can be used.

The ink-receiving layer of the present invention is preferably coated on one side of the support as a plurality of at least two distinct layers, coated from different coating solutions. Most preferably, the ink-receiving layer of the present invention is coated on one side of the support as a plurality of three distinct layers, coated from different coating solutions. When the ink jet receiving sheet of the present invention contains at least two ink receiving layers coated on one side of the support, at least one of said ink receiving layers contains the copolymer consisting of at least one N-vinylpyrrolidone monomer or derivatives thereof and at least one monomer selected within the group of N-vinylcaprolactam, N-vinylpiperidone monomer or their derivatives. Preferably, all said ink receiving layers contain said copolymer, in the same or in different amounts. The ink jet receiving layer of the present invention can also contain at least an ink receiving layer coated on both sides of the support; in that case, at least one of said receiving layers contains the copolymer cited above. When preparing an ink-jet receiving sheet by coating two or more ink-receing layers onto a support, it is possible to prepare an ink-receiving sheet with excellent properties, especially with respect to glossiness and post printed drop sweating after stressed ageing.

The ink jet receiving sheet of the invention has a surface pH value lower than 5.0, preferably in the range from 3.5 to 4.5. At surface pH values lower than 5 good glossiness, defined as the quantity of reflected light measured at a predetermined angle (generally at 20°, 60° or 85°) with respect to the direction of the incident light and expressed in percentage, can be noted.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLES

Example 1

Sample 1 (reference).

An ink jet receiving sheet was prepared using a support comprising a paper base having a weight of 170 g/m$^2$. Both sides of this paper support were coated with a resin layer consisting of a 25 g/m$^2$ weight low density polyethylene. A gelatin primer was coated on the front side and an anticurl gelatin layer was coated on the back side.

Three coating solutions were prepared using the components indicated below dissolved in water. The solutions were adjusted to pH 4.4 using nitric acid before coating them all at once with extrusion system at 8.7 meter by mi??nute on the front side of the aforementioned support.

The resulting coating was dried to give a multilayer inkjet receiving sheet with the following composition:

First layer: 2.03 g/m$^2$ of gelatin; 0.17 g/m$^2$ of Glucidex™-19, a polysaccharide available from Roquette and 0.03 g/m$^2$ of Triton™X-100;

Second layer: 5.2 g/m$^2$ of gelatin, 2.86 g/m$^2$ of PVP-K 90, 0.40 g/m$^2$ of Glucidex™19, 0.07 g/m$^2$ of Triton™X100, and 0.27 g/m$^2$ of fines particles of aluminum oxide;

Third layer: 0.48 g/m$^2$ of gelatin, 0.24 g/m$^2$ of PVP-K 90, 0.04 g/m$^2$ of Glucidex™19, 0.05 g/m$^2$ of Zonyl™FSN 100, 0.16 g/m$^2$ of P.M.M.A. and 0.015 g/m$^2$ of hardening agent H-1.

Sample 2 (invention).

The procedure of sample 1 was repeated with the same ingredients, except that PVP-K 90 in the third layer were replaced by PVP/PVcap copolymer.

Sample 3 (invention).

The procedure of sample 2 was repeated with the same ingredients, with the exception that the amount of PVP/PVcap copolymer used in the third layer was of 0.36 g/m$^2$.

Sample 4 (invention).

The procedure of sample 3 was repeated with the same ingredients, except that 25% by weight of PVP-K 90 in the second layer were replaced with PVP/PVcap copolymer.

Sample 5 (invention).

The procedure of sample 3 was repeated with the same ingredients, except that 50% by weight of PVP-K 90 in the second layer were replaced by PVP/PVcap copolymer.

Sample 6 (invention).

The procedure of sample 3 was repeated with the same ingredients, except that 100% by weight of PVP-K 90 in the second layer were replaced with PVP/PVcap copolymer.

An evaluation image pattern was printed on samples 1 to 6 using a Stylus Photo 740 color ink jet printer (produced by Epson). The color maximum density was generated using a dye and the ink was uniformly jetted at maximum ink jetting amount possibility of the printer. The obtained printed samples were submitted to sweating evaluation after printing at 23° C. and 80% relative humidity for 4 hours incubation. The printed surface was inspected to detect the presence of organic drop sweating. For each evaluation, a ranking score was given from 1 to 10, wherein 10 means "Surface completely free of sweating drops" and 1 means "Very high level of sweating drops observed". The glossiness was measured on non-printed patches at an angle of 60° with a TRI-Microgloss-160 (Produced by Sheen) as disclosed in ASTM standard No. 523. The results are shown in Table 1.

TABLE 1

| | PVP g/m$^2$ | | PVP-Cap g/m$^2$ | | | |
|---|---|---|---|---|---|---|
| Sample | Layer II | Layer III | Layer II | Layer III | Glossiness | Sweating |
| 1 (Ref.) | 2.86 | 0.24 | 0 | 0 | 59.7 | 5 |
| 2 (Inv.) | 2.86 | 0 | 0 | 0.24 | 61.5 | 8 |
| 3 (Inv.) | 2.86 | 0 | 0 | 0.36 | 60.5 | 8.5 |
| 4 (Inv.) | 2.14 | 0 | 0.72 | 0.36 | 66.3 | 9.5 |
| 5 (Inv.) | 1.43 | 0 | 1.43 | 0.36 | 68.2 | 10 |
| 6 (Inv.) | 0 | 0 | 2.86 | 0.36 | 70.7 | 10 |

As we can see from table 1, Samples 2 to 6 of the present invention, containing a polyvinylpyrrolidone/ polyvinylcaprolactam copolymer in the second and/or in the third layer, show a significant reduction of the problem of post printed drop sweating, still maintaining a good glossiness. On the contrary, reference Sample 1 not containing said copolymer show bad sweating values.

Triton™ X-100 is the trade name of a non-ionic surfactant of the alkylphenoxyethylene type, distributed by Union Carbide Co., Dambury, Conn., USA and corresponding to the following formula:

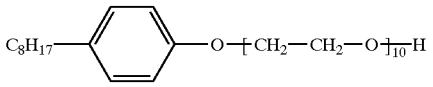

Zonyl™ FSN 100 is the trade name of a non-ionic surfactant of the perfluoroalkylpolyoxyethylene type, manufactured by DuPont Co., Wilmington, Del., USA and corresponding to the following formula:

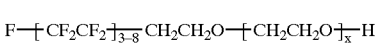

Hardening agent H-1 is a pyridinium derivative having the following formula:

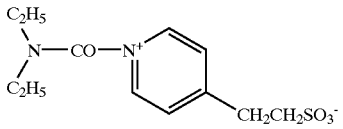

Glucidex™ 19 is the trade names of a polysaccharide available from Roquette Freres S. A., Lille, France.

PVP-K 90 is a polyvinylpyrrolidone available from Fluka, a division of Sigma-Aldrich Co., St. Louis, Mo., USA.

PVPCap is a polyvinylpyrrolidone/polyvinylcaprolactam copolymer (50/50) available from Basf AG, Germany.

Example 2

Sample 7 (invention).

The procedure of sample 4 was repeated with the same ingredients, but for the introduction in the second layer of a vinylpyrrolidone/3-methyl-1-vinylimidazolium methyl sulfate copolymer in the amount of 25% by weight respect to the total vinylic polymers of the layer.

Dry time is improved

| | Black | Red | Green | Blue | Motting | Glossiness |
|---|---|---|---|---|---|---|
| Sample 4 | 0.11 | 0.05 | 0.13 | 0.31 | 4.0 | 17 |
| Sample 7 | 0.05 | 0.03 | 0.10 | 0.03 | 4.8 | 22 |

What is claimed is:

1. An ink jet receiving sheet comprising a support and at least one ink receiving layer comprising from 30–70% by weight of a binder selected from the group consisting of gelatin and gelatin derivatives, characterized in that said at least an ink receiving layer comprises at least a copolymer consisting of at least one N-vinylpyrrolidone monomer and at least one second monomer selected from the group consisting of N-vinylcaprolactam monomers and N-vinylpiperidone monomers wherein there are three layers of ink jet receiving material on one side of the support and at least an uppermost ink jet receiving layer from 30–70% by weight of a binder selected from the group consisting of gelatin and gelatin derivatives, characterized in that said at least an ink receiving layer comprises at least a copolymer consisting of at least one N-vinylpyrrolidone monomer and at least N-vinylcaprolactam monomers as a second monomer.

2. An ink jet receiving sheet comprising a support and at least one ink receiving layer comprising from 30–70% by weight of a binder selected from the group consisting of gelatin and gelatin derivatives, characterized in that said at least an ink receiving layer comprises at least a copolymer consisting of at least one N-vinylpyrrolidone monomer and at least one second monomer selected from the group consisting of N-vinylcaprolactam monomers and N-vinylpiperidone monomers, wherein said second monomer is selected from the group consisting of N-vinylcaprolactam monomers, and wherein there are three layers of ink jet receiving material on one side of the support and at least an uppermost ink jet receiving layer from 30–70% by weight of a binder selected from the group consisting of gelatin and gelatin derivatives, characterized in that said at least an ink receiving layer comprises at least a copolymer consisting of at least one N-vinylpyrrolidone monomer and at least N-vinylcaprolactam monomers as a second monomer.

3. An ink jet receiving sheet comprising a support and at least one ink receiving layer comprising from 30–70% by weight of a binder selected from the group consisting of gelatin and gelatin derivatives, characterized in that said at least an ink receiving layer comprises at least a copolymer consisting of at least one N-vinylpyrrolidone monomer and at least one second monomer selected from the group consisting of N-vinylcaprolactam monomers and N-vinylpiperidone monomers, wherein said at least one ink receiving layer comprises a total amount of said copolymer in the range from about 0.1 to about 10 g/m$^2$, and wherein there are three layers of ink jet receiving material on one side of the support and at least an uppermost ink jet receiving layer from 30–70% by weight of a binder selected from the group consisting of gelatin and gelatin derivatives, characterized in that said at least an ink receiving layer comprises at least a copolymer consisting of at least one N-vinylpyrrolidone monomer and at least N-vinylcaprolactam monomers as a second monomer.

4. An ink jet receiving sheet comprising a support and at least one ink receiving layer comprising from 30–70% by weight of a binder selected from the group consisting of gelatin and gelatin derivatives, characterized in that said at least an ink receiving layer comprises at least a copolymer consisting of at least one N-vinylpyrrolidone monomer and at least one second monomer selected from the group consisting of N-vinylcaprolactam monomers and N-vinylpiperidone monomers, wherein said second monomer is present in the copolymer in proportions of from 10% to 90%, based on the molecular weight of the total copolymer, and wherein there are three layers of ink jet receiving material on one side of the support and at least an uppermost ink jet receiving layer from 30–70% by weight of a binder selected from the group consisting of gelatin and gelatin derivatives, characterized in that said at least an ink receiving layer comprises at least a copolymer consisting of at least one N-vinylpyrrolidone monomer and at least N-vinylcaprolactam monomers as a second monomer.

5. An ink jetreceiving sheet comprising a support and at least one ink receiving layer comprising from 30–70% by weight of a binder selected from the group consisting of gelatin and gelatin derivatives, characterized in that said at least an ink receiving layer comprises at least a copolymer consisting of at least one N-vinylpyrrolidone monomer and at least N-vinylcaprolactam monomers as a second monomer, wherein said at least one ink receiving layer comprises a total amount of said copolymer in the range from about 0.1 to about 10 g/m$^2$, and said second monomer is present in the copolymer in proportions of from 20 to 80%, based on the molecular weight of the total copolymer, and wherein there are three layers of ink jet receiving material on one side of the support and at least an uppermost ink jet receiving layer comprises from 30–70% by weight of a binder selected from the group consisting of gelatin and gelatin derivatives, characterized in that said at least an ink receiving layer comprises at least a copolymer consisting of at least one N-vinylpyrrolidone monomer and at least N-vinylcaprolactam monomers as a second monomer, wherein said at least one ink receiving layer comprises a total amount of said copolymer in the range from about 0.1 to about 10 g/m$^2$, and said second monomer is present in the copolymer in proportions of from 20 to 80%, based on the molecular weight of the total copolymer.

* * * * *